US007258575B1

(12) United States Patent
Weng

(10) Patent No.: US 7,258,575 B1
(45) Date of Patent: Aug. 21, 2007

(54) LIGHT SENSE CONTROLLER

(76) Inventor: Rui-Hong Weng, No. 5, Lane 72, Kuei Yang St., Tai Shan Hsiang, Taipei Hsien (TW)

( * ) Notice: Subject to any disclaimer, the term of this patent is extended or adjusted under 35 U.S.C. 154(b) by 0 days.

(21) Appl. No.: 11/477,354

(22) Filed: Jun. 30, 2006

(51) Int. Cl.
*H01R 13/66* (2006.01)
*H01H 35/14* (2006.01)

(52) U.S. Cl. ..... 439/620.01; 307/117

(58) Field of Classification Search ..... 439/620.01; 361/728; 307/116, 117; 363/146
See application file for complete search history.

(56) References Cited

U.S. PATENT DOCUMENTS 6,060,838 A * 5/2000 Cantoni et al. ..... 315/159
2003/0092297 A1* 5/2003 Reindle et al. ..... 439/107
2006/0044858 A1* 3/2006 Holme Pedersen et al. . 363/136

FOREIGN PATENT DOCUMENTS

JP 410050390 A * 2/1998

* cited by examiner

*Primary Examiner*—Thuy Vinh Tran
(74) *Attorney, Agent, or Firm*—Rosenberg, Klein & Lee

(57) ABSTRACT

A light sense controller uses a light sensor to sense light variations, and then turns a socket on or off in response to the light levels for controlling household appliances coupled the socket. The light sense controller includes a plug and at least one socket. A step-down circuit couples to the plug for receiving AC power and outputting a supply voltage. A stabilizer couples to the step-down circuit for receiving the supply voltage, and outputs a first and second work voltage. A light sensor outputs a control signal in response to ambient brightness. A controller couples to the stabilizer and the light sensor for receiving the first work voltage and the control signal, and outputs a drive signal. An outputting circuit couples to the stabilizer, the controller, the plug, and the socket for receiving the second work voltage and the drive signal, and turns the socket on or off.

9 Claims, 3 Drawing Sheets

LIGHT SENSE CONTROLLER

BACKGROUND OF THE INVENTION

1. Field of the Invention

The present invention relates to a light sense controller, and more specifically relates to a controller for turning a socket on or off in response to ambient brightness.

2. Description of the Related Art

In general, there are usually an insufficient number of sockets in a house to provide electrical power. Therefore, a user often uses a socket with an extended line or a socket with multiple holes for increasing the number of sockets available for various household appliances. However, the user often forgets to turn off the household appliance once they have finished using it, therefore wasting power. Therefore, it is necessary to create a socket that can switch on or off automatically in response to light levels.

SUMMARY OF THE INVENTION

Accordingly, the objective of the present invention is to provide a light sense controller that turns a socket on or off in response to ambient brightness.

The light sense controller of the present invention includes a plug, at least one socket, a step-down circuit, a stabilizer, a light sensor, a controller, and an outputting circuit. The plug receives AC power. Moreover, the step-down circuit couples to the plug for receiving the AC power and outputs a supply voltage. The stabilizer couples to the step-down circuit for receiving the supply voltage, and outputs a first work voltage and a second work voltage. The light sensor outputs a control signal in response to ambient brightness. The controller couples to the stabilizer and the light sensor for receiving the first work voltage and the control signal, and outputs a drive signal. The outputting circuit couples to the stabilizer, the controller, the plug and the socket for receiving the second work voltage and the drive signal, and turns the socket on or off.

BRIEF DESCRIPTION OF THE DRAWINGS

The various objectives and advantages of the present invention will be more readily understood from the following detailed description when read in conjunction with the appended drawing, in which.

DETAILED DESCRIPTION OF THE PREFERRED EMBODIMENTS

Figure 1:
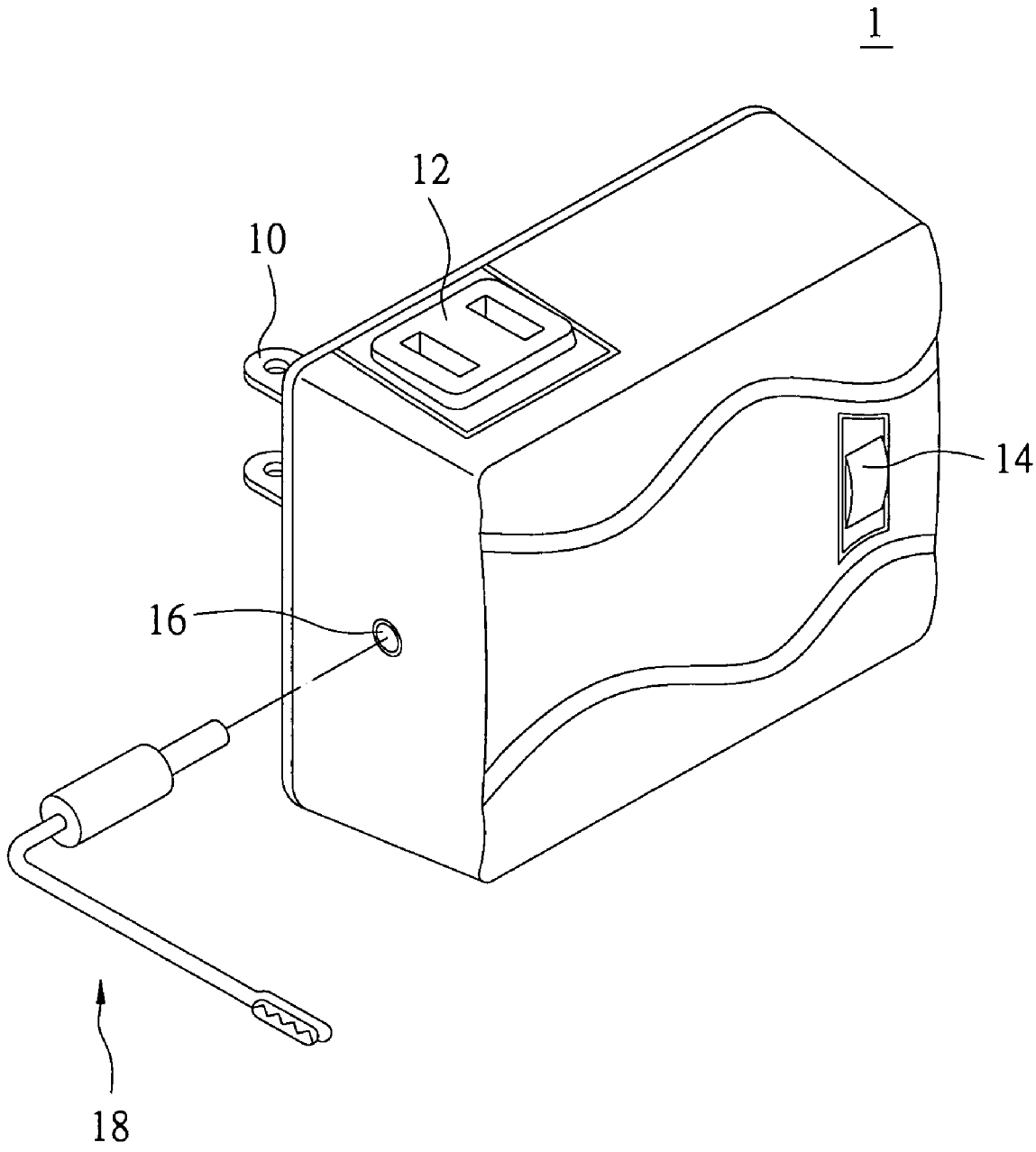
FIG. 1 shows an appearance diagram of the present invention.

FIG. 1 shows an appearance diagram of the present invention. The light sense controller 1 has a plug 10, the plug 10 is plugged into the wall socket (not shown) for receiving AC power. The light sense controller 1 further includes at least one socket 12, and turns the socket 12 on or off in response to a light sensor 14 sensing light levels, wherein the light sensor 14 is a light sensitive resistor. Furthermore, the user can use an external light sensor 18 to plug in an external socket 16 actively, wherein the external light sensor 18 is a light sensitive resistor.

Figure 2:
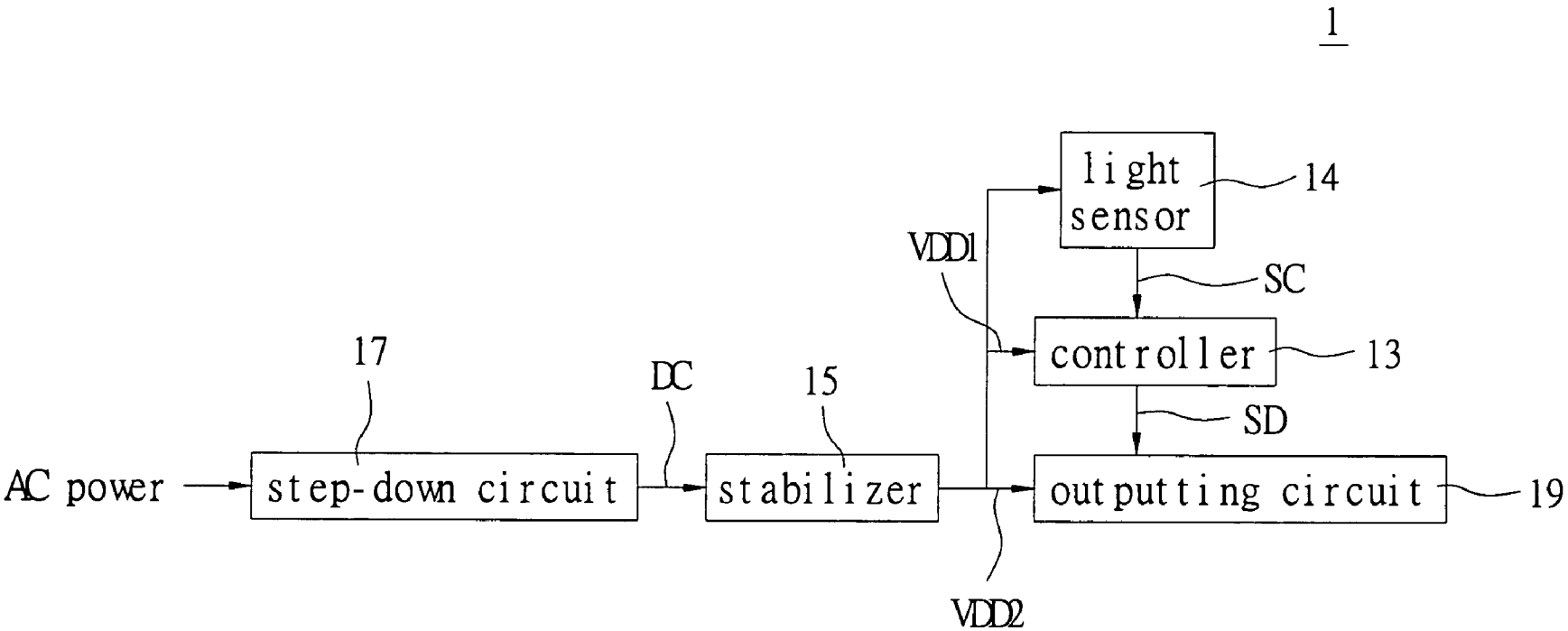
FIG. 2 shows a circuit block diagram of the present invention.

With reference to FIG. 1, FIG. 2 shows a circuit block diagram of the present invention. The light sense controller 1 includes a step-down circuit 17 coupled to the plug 10 for receiving AC power and outputs a supply voltage DC. The light sense controller 1 further includes a stabilizer 15 coupled to the step-down circuit 17 for receiving the supply voltage DC and outputting a first work voltage VDD1 and a second work voltage VDD2. Moreover, the light sense controller 1 uses a light sensor 14 to output a control signal SC in response to ambient brightness. In the light sense controller 1, a controller 13 couples to a stabilizer 15 and the light sensor 14 for receiving the first work voltage VDD1 and the control signal SC, and outputs a drive signal SD. Furthermore, in the light sense controller 1, an outputting circuit 19 couples to the stabilizer 15, the controller 13, the plug 10 and the socket 12 for receiving the second work voltage VDD2 and the drive signal SD, and turns the socket 12 on or off.

Figure 3:
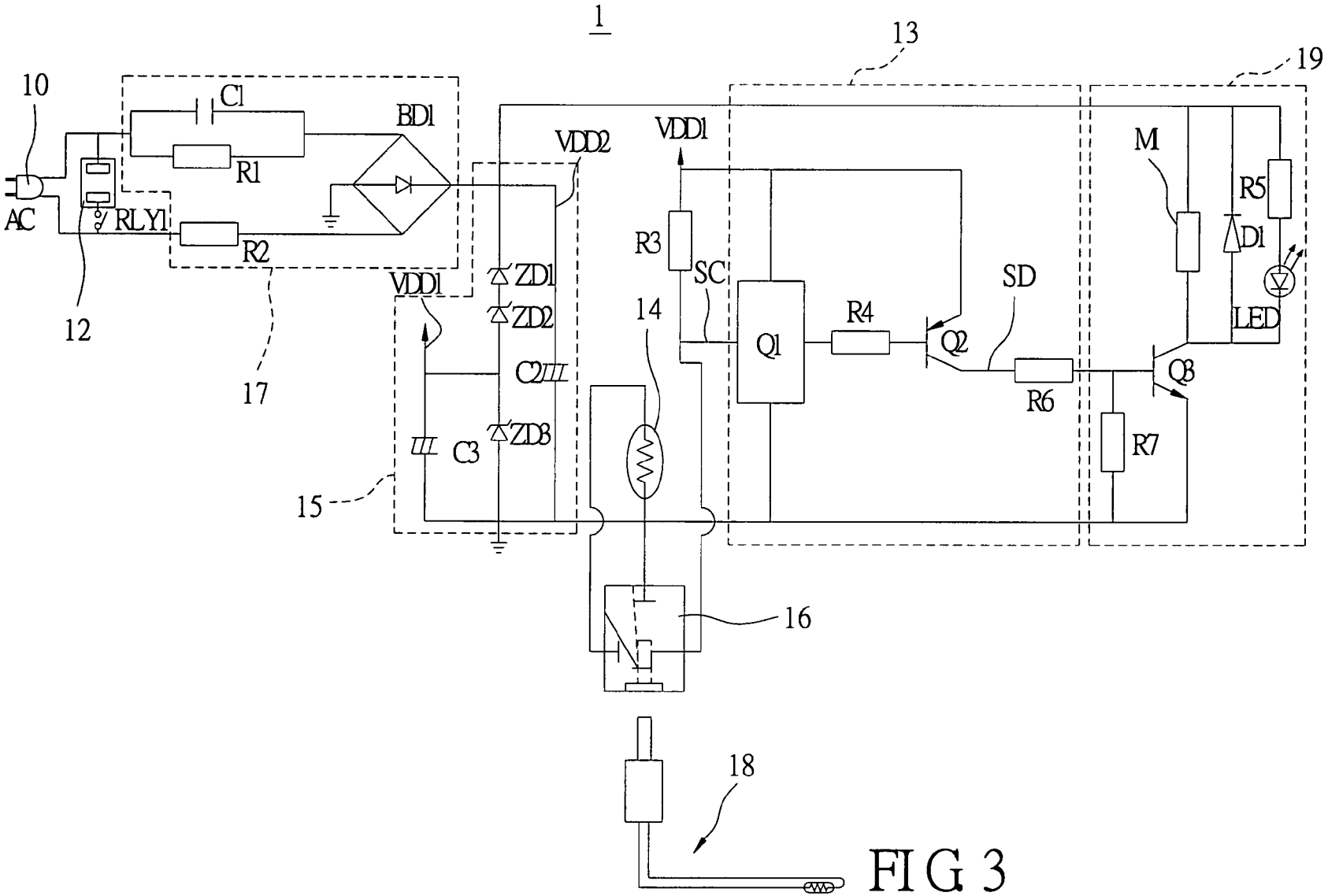
FIG. 3 shows a circuit diagram of the present invention.

FIG. 3 shows a circuit diagram of the present invention. The step-down circuit 17 of the light sense controller 1 includes a parallel assembly having a resistance R1 and a capacitance C1, a rectifier BD1, and a current limit resistor R2. The parallel assembly (R1, C1) is used to step AC power down. The rectifier BD1 couples to the parallel assembly (R1, C1) for rectifying the step-down AC power and outputs the supply voltage DC. The current limit resistor R2 couples to the plug 10 and the rectifier BD1.

Referring to FIG. 3, the stabilizer 15 of the light sense controller 1 includes a series zener diode (ZD1, ZD2, ZD3), a first capacitance C3, and a second capacitance C2. The series zener diode (ZD1, ZD2, ZD3) couples to the step-down circuit 17 for outputting the supply voltage DC steadily. The first capacitance C3 couples to the series zener diode (ZD1, ZD2, ZD3) for building the first work voltage VDD1. The second capacitance C2 couples to the series zener diode (ZD1, ZD2, ZD3) for building the second work voltage VDD2.

Referring to FIG. 3, the controller 13 of the light sense controller 1 includes a control chip Q1 and a switch Q2. The control chip Q1 couples to the stabilizer 15 and the light sensor 14 for receiving the first work voltage VDD1. Moreover, the switch Q2 couples to the control chip Q1 and is controlled by the control chip Q1 for outputting the drive signal SD.

Referring to FIG. 3, the outputting circuit 19 of the light sense controller 1 includes a power switch Q3, a relay (not shown) and an indicator light LED. The power switch Q3 couples to the controller 13 and the stabilizer 15 for receiving the drive signal SD. Moreover, the power switch Q3 is controlled by the drive signal SD. The relay has a magnet winding M1 and at least one electric contact RLY1, wherein the magnet winding M1 couples to the power switch Q3 and the stabilizer 15, and the electric contact RLY1 couples to the plug 10 and the socket 12. Furthermore, the indicator light LED couples to the power switch Q3 and the stabilizer 15.

Referring to FIG. 3, the light sense controller 1 further includes an external socket 16 coupled to the controller 13, and an external light sensor 18 plugged into the external socket 16 actively.

Referring to FIG. 3, the light sense controller 1 receives AC power from the plug 10. The step-down circuit 17 steps AC power down for outputting the supply voltage DC. The stabilizer 15 outputs the first work voltage VDD1 to the controller 13 and the second work voltage VDD2 to the outputting circuit 19 separately in response to the supply voltage DC. The resistance of the light sensor 14 is changed according to the ambient brightness. Therefore, the light sensor 14 outputting the control signal SC to the controller 13 responds to the change in the resistance of the light sensor 14. Therefore, when the surrounding environment is bright, the controller 13 excites the magnet winding M1 for closing the electric contact RLY1. AC power is transmitted to the socket 12 when the electric contact RLY1 is closed.

On the other hand, when the surrounding environment is dark, the controller 13 stops exciting the magnet winding M1 for opening the electric contact RLY1. The AC power isn't transmitted to the socket 12 when the electric contact RLY1 is opened.

To sum up, the light sense controller 1 of the present invention uses the light sensor to sense variations in ambient brightness and then turns the socket on or off in response to the light level for controlling the household appliance coupled to the socket to turn on or off. Moreover, the present invention relates to a socket for household appliances to turn on or off in response to light levels.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A light sense controller, comprising:

a plug for receiving AC power;

at least one socket;

a step-down circuit coupled to the plug for receiving AC power and outputting a supply voltage;

a stabilizer coupled to the step-down circuit for receiving the supply voltage and outputting a first work voltage and a second work voltage;

a light sensor for outputting a control signal in response to ambient brightness;

a controller coupled to the stabilizer and the light sensor for receiving the first work voltage and the control signal, and outputting a drive signal; and an outputting circuit coupled to the stabilizer, the controller, the plug, and the socket for receiving the second work voltage and the drive signal, and turning the socket on or off.

2. The controller of claim 1, wherein the step-down circuit comprises:

a parallel assembly having a resistance and a capacitance, the parallel assembly steps the AC power down;

a rectifier coupled to the parallel assembly for rectifying the step-down AC power and outputting the supply voltage; and a current limit resistor coupled to the plug and the rectifier.

3. The controller of claim 1, wherein the stabilizer comprises:

a series zener diode coupled to the step-down circuit for outputting the supply voltage steadily;

a first capacitance coupled to the series zener diode for building the first work voltage; and a second capacitance coupled to the series zener diode for building the second work voltage.

4. The controller of claim 1, wherein the light sensor is a light sensitive resistor.

5. The controller of claim 1, wherein the controller comprises:

a control chip coupled to the stabilizer and the light sensor for receiving the first work voltage; and a switch coupled to the control chip, the switch being controlled by the control chip for outputting a drive signal.

6. The controller of claim 1, wherein the outputting circuit comprises:

a power switch coupled to the controller and the stabilizer, the power switch being controlled by the drive signal;

a relay having a magnet winding and at least one electric contact, the magnet winding coupled to the power switch and the stabilizer, and the electric contact coupled to the plug and the socket; and an indicator light coupled to the power switch and the stabilizer.

7. The controller of claim 1, further comprising an external socket coupled to the controller.

8. The controller of claim 7, further comprising an external light sensor plugged into the external socket actively.

9. The controller of claim 8, wherein the external light sensor is a light sensitive resistor.

* * * * *